US010206832B2

(12) United States Patent
Danielsson et al.

(10) Patent No.: US 10,206,832 B2
(45) Date of Patent: Feb. 19, 2019

(54) SWING ARM LINKAGE FOR A MID-WHEEL DRIVE WHEELCHAIR

(71) Applicant: Permobil AB, Timrå (SE)

(72) Inventors: Anton Danielsson, Sundsvall (SE); Herbert Van de Wal, Alnö (SE)

(73) Assignee: PERMOBIL AB (SE)

( * ) Notice: Subject to any disclaimer, the term of this patent is extended or adjusted under 35 U.S.C. 154(b) by 72 days.

(21) Appl. No.: 15/624,316

(22) Filed: Jun. 15, 2017

(65) Prior Publication Data

US 2018/0008493 A1 Jan. 11, 2018

(30) Foreign Application Priority Data

Jul. 7, 2016 (EP) ..... 16178324

(51) Int. Cl.

*A61G 5/04* (2013.01)
*A61G 5/10* (2006.01)
*A61G 5/06* (2006.01)

(52) U.S. Cl.

CPC ..... *A61G 5/1078* (2016.11); *A61G 5/043* (2013.01); *A61G 5/06* (2013.01); *A61G 5/1089* (2016.11)

(58) Field of Classification Search

CPC .... A61G 5/1078; A61G 5/1089; A61G 5/043; A61G 5/06

See application file for complete search history.

(56) References Cited

U.S. PATENT DOCUMENTS 4,245,847 A * 1/1981 Knott ..... A61G 5/06 280/47.16
7,293,801 B2 * 11/2007 Bertrand ..... A61G 5/043 280/755

(Continued)

OTHER PUBLICATIONS

European Search Report for Application No. EP 16178324.6, dated Jan. 11, 2017, 6 pages.

*Primary Examiner* — Drew J Brown
(74) *Attorney, Agent, or Firm* — McAndrews, Held & Malloy, Ltd.

(57) ABSTRACT

The present disclosure relates to a swing arm linkage (1) for a mid-wheel drive wheelchair, comprising: a first swing arm (3) having a first swing arm pivot point (3*a*) and a linkage member first mounting point (3*b*), a second swing arm (5) having a second swing arm pivot point (5*a*) and a linkage member second mounting point (5*b*), a linkage member (7) configured to be connected to the linkage member first mounting point (3*b*) and to the linkage member second mounting point (5*b*), to enable force transfer between the second swing arm (5) and the first swing arm (3), wherein the linkage member (7) has an elongated shape defining a linkage axis (A) extending between the linkage member first mounting point (3*b*) and the linkage member second mounting point (5*b*), a first straight line being formed between the first swing arm pivot point (3*a*) and the linkage member first mounting point (3*b*), and a second straight line being formed between the second swing arm pivot point (5*a*) and the linkage member second mounting point (5*b*), wherein the linkage member first mounting point (3*b*) and the linkage member second mounting point (5*b*) are so arranged relative to each other that the sum of an angle α between the linkage axis and a line perpendicular to the first straight line and extending from the linkage member first mounting point and an angle β between the linkage axis and a line perpendicular (Continued)

to the second straight line and extending from the linkage member second mounting point is constant or increasing with increasing ditch angle.

11 Claims, 3 Drawing Sheets

(56) References Cited

U.S. PATENT DOCUMENTS

| | | | | |
|---|---|---|---|---|
| 7,828,310 | B2 * | 11/2010 | Vreeswijk | A61G 5/043 180/22 |
| 7,896,394 | B2 | 3/2011 | Jackson | |
| 8,113,531 | B2 | 2/2012 | Zhou | |
| 8,210,556 | B2 * | 7/2012 | Zhou | A61G 5/043 180/209 |
| 8,851,214 | B2 * | 10/2014 | Mirzaie | A61G 5/043 180/65.1 |
| 9,913,768 | B2 * | 3/2018 | Cuson | A61G 5/06 |
| 2005/0206149 | A1 * | 9/2005 | Mulhern | A61G 5/043 280/755 |
| 2007/0209848 | A1 * | 9/2007 | Tang | A61G 5/043 180/65.1 |
| 2010/0084209 | A1 * | 4/2010 | Bekoscke | A61G 5/043 180/209 |

* cited by examiner

SWING ARM LINKAGE FOR A MID-WHEEL DRIVE WHEELCHAIR

CROSS-REFERENCE TO RELATED APPLICATIONS/INCORPORATION BY REFERENCE

The present application claims priority to European Patent Application No. 16178324.6, filed Jul. 7, 2016. The content of the above-identified application is hereby incorporated herein by reference in its entirety.

TECHNICAL FIELD

The present disclosure generally relates to powered wheelchairs. In particular, it relates to a swing arm linkage for a mid-wheel drive wheelchair suspension and a mid-wheel drive wheelchair comprising such a linkage.

BACKGROUND

Powered wheelchairs may be of different configurations, one aspect being to how the drive wheels are placed. Mid-wheel drive wheelchairs have front wheels, rear wheels, and drive wheels arranged between the front wheels and the rear wheels. The front and rear wheels may in this case be caster-type wheels. In comparison to front-wheel and rear-wheel driven wheelchairs, mid-wheel drive wheel chairs are sometimes considered to present a better manoeuvrability, mainly in terms of a lesser turning radius. In addition to manoeuvrability, some other important aspects when designing and configuring a wheelchair are stability and the ability for a wheel suspension assembly to ensure that all wheels are in contact with the ground at all times. Traditionally, there has often been a trade-off for one against the other in the context of mid-wheel drive wheelchairs. Stability may in one aspect be defined as the ability of preventing tipping of the wheelchair about its pitch axis, e.g. tipping over in the forward or rearward direction or lifting of rear or front caster wheels when driving on a ramp or a slope. It is especially important that the drive wheel maintains traction against the ground since the wheelchair otherwise will lose its ability to be driven, in any direction. The risk for loss of tractive force increases when operating the wheelchair on a non-planar surface, e.g. on uneven ground. The phenomena when such a situation occurs for a mid-wheel drive wheelchair is sometimes referred to as high-centering, meaning that at least one of the drive wheels has lost contact with the ground. There is also an increased risk of losing traction when entering or leaving a slope, downhill or uphill.

The suspension assembly of a wheelchair generally comprises at least one shock absorber, typically comprising a spring and a damper, swing arms (a.k.a. link arms or pivot arms) pivotably connected to the chassis to which front and rear caster wheels are mounted, the wheels themselves and the connections of swing arms and/or wheels to the chassis. The shock absorber is generally arranged between the chassis and at least one swing arm. Compression springs may generally be divided into five different types depending on their compression behavior, i.e. the rate at which the spring compresses. The different types are: linear, progressive, progressive with a knee, almost constant and degressive. Previous solutions have typically used springs of either linear or any of the progressive types listed above. All of these spring types provide an increase in spring force the greater the movement of the swing arms. This has typically also led to the suspension as a whole exhibiting the same characteristic.

U.S. Pat. No. 7,896,394 B2 discloses a mid-wheel drive wheelchair with independent front and rear suspension to enable a better ability to ascend and descend obstacles. The wheelchair includes a frame, and a front pivot arm pivotally mounted to the frame at a front pivot point, the front pivot arm having a caster wheel. A rear pivot arm is pivotally mounted to the frame at a rear pivot point, the rear pivot arm having a caster wheel. A ground engaging centre-placed drive wheel is connected to the frame between the front pivot caster wheel and the rear pivot caster wheel. A linkage connects the front and rear pivot arms to each other in a manner such that an upward or downward rotation of one of the pivot arms about its pivot point causes rotation of the other pivot arm about its pivot point in an opposite rotational direction.

U.S. Pat. No. 8,851,214B2 also discloses a mid-wheel drive wheelchair with a suspension arrangement which comprises a linkage connecting front and rear link arms.

SUMMARY

Mid-wheel drive wheelchairs generally face the problem of maintaining adequate stability while improving the maintenance of all wheels in contact with the ground even when encountering uneven surfaces. It is desirable to have a relatively stiff suspension during normal driving conditions, i.e. on plane even ground. When encountering unevenness, such as e.g. an obstacle or a hole in the ground, which require the swing arms to pivot, the suspension should exhibit a degressive increase in stiffness the greater the swing arm movement is, in order for the wheelchair to be able to maintain all wheels in contact with the ground.

The degree of unevenness encountered by a wheelchair can be expressed as a "ditch angle", the ditch angle being defined as the acute angle between two planes, a first plane that is tangent to both the front caster wheel contact point to the ground and a ground contact point of the drive wheel, and a second plane that is tangent to the rear caster wheel ground contact point and a drive wheel ground contact point. The term comes from imagining a ditch where the drive wheel is at the lowermost point of a ditch and the front and rear wheels on respective sides of the ditch. Typically used suspension arrangements would exhibit either a linear, progressive or progressive with a knee behaviour, more or less directly corresponding to the characteristic of the spring used in the shock absorber, thereby limiting the ability for the wheel pairs to maintain contact with ground and reducing the maximum ditch angle that may be traversed without loss of traction.

In view of the above, a general object of the present disclosure is to provide a swing arm linkage for a mid-wheel drive wheelchair which solves or at least mitigates the problems of the prior art.

There is hence according to a first aspect of the present disclosure provided a swing arm linkage for a mid-wheel drive wheelchair, comprising: a first swing arm having a first swing arm pivot point and a linkage member first mounting point, a second swing arm having a second swing arm pivot point and a linkage member second mounting point, a linkage member configured to be connected to the linkage member first mounting point and to the linkage member second mounting point, to enable force transfer between the second swing arm and the first swing arm, wherein the linkage member has an elongated shape defining a linkage axis extending between the linkage member first mounting point and the linkage member second mounting point, a first straight line being formed between the first swing arm pivot point and the linkage member first mounting point, and a second straight line being formed between the second swing arm pivot point and the linkage member second mounting point, wherein the linkage member first mounting point and the linkage member second mounting point are so arranged relative to each other that the sum of an angle α between the linkage axis and a line perpendicular to the first straight line and extending from the linkage member first mounting point and an angle β between the linkage axis and a line perpendicular to the second straight line and extending from the linkage second mounting point is constant or increasing with increasing ditch angle.

Due to the geometric positions of the second swing arm pivot point, the first swing arm pivot point, the linkage member first mounting point and the linkage member second mounting point, the stiffness increase of the suspension is degressive. Even if the spring used in the shock absorber may still be a linear rate spring, the behaviour of the suspension as a whole is degressive as opposed to previous solutions, due to the suspension geometry. The swing arm linkage hence allows for a mid-wheel drive wheelchair suspension that is stable, is able to maintain the wheel pairs in ground contact to a higher degree, and is comfortable.

Furthermore, the specified geometry provides traction for the drive wheels for higher ditch angles. In particular, the present geometry may be able to provide drive wheel traction for ditch angles greater than 25 degrees.

It is to be noted that the "first straight line" and the "second straight line" are no actual structural features of the swing arm linkage, in the same way as an "axis" is not a physical attribute of a structure as compared to an "axle"; hereto the "first straight line" and the "second straight line" are imaginary lines recited merely for facilitating the definition of the angles α and β. The same also applies to the lines that are perpendicular to a respective one of the first straight line or the second straight line.

In general, the lower the sum of the angles α and β is, more of the motion is transferred between the second swing arm and the first swing arm.

According to one embodiment the sum of the angles α and β is less than 30 degrees at a ditch angle of zero.

According to one embodiment the sum of the angles α and β is less than 25 degrees at a ditch angle of zero.

According to one embodiment the sum of the angles α and β is less than 20 degrees at a ditch angle of zero.

According to one embodiment sum of the angles α and β is less than to degrees at a ditch angle of zero.

According to one embodiment the ratio between the leverage arm of the second swing arm and the leverage arm of the first swing arm is constant with increasing ditch angle.

It is considered that the more constant the ratio between the leverage arm of the second swing arm and the leverage arm of the first swing arm can be kept over the range of ditch angles, for a given force the same force transmission will always be provided from the second swing arm to the first swing arm, regardless of the second swing arm position.

According to one embodiment the ratio between the leverage arm of the second swing arm and the leverage arm of the first swing arm is between 2 and 3 for any ditch angle between 0 and 25 degrees.

According to one embodiment the first swing arm is a rear swing arm and the second swing arm is a front swing arm.

According to one embodiment the line perpendicular to the first straight line intersects an extension of the second straight line, and the line perpendicular to the second straight line intersects an extension of the first straight line.

There is according to a second aspect of the present disclosure provided a mid-wheel drive wheelchair comprising a swing arm linkage according to the first aspect presented herein.

One embodiment comprises a chassis, wherein the first swing arm is pivotally connected to the chassis via the first swing arm pivot point and the second swing arm is pivotally connected to the chassis via the second swing arm pivot point.

Generally, all terms used in the claims are to be interpreted according to their ordinary meaning in the technical field, unless explicitly defined otherwise herein. All references to "a/an/the element, apparatus, component, means", etc. are to be interpreted openly as referring to at least one instance of the element, apparatus, component, means, etc., unless explicitly stated otherwise.

BRIEF DESCRIPTION OF THE DRAWINGS

The specific embodiments of the inventive concept will now be described, by way of example, with reference to the accompanying drawings, in which.

DETAILED DESCRIPTION

Figure 1:
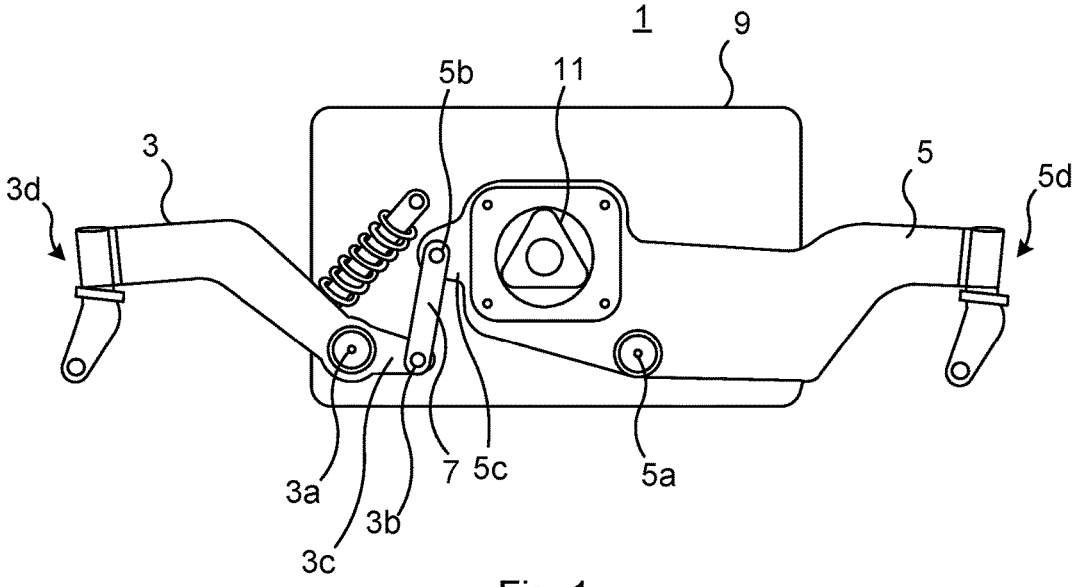
FIG. 1 is a schematic side view of an example of a swing arm linkage for a mid-wheel drive wheelchair.

The inventive concept will now be described more fully hereinafter with reference to the accompanying drawings, in which exemplifying embodiments are shown. The inventive concept may, however, be embodied in many different forms and should not be construed as limited to the embodiments set forth herein; rather, these embodiments are provided by way of example so that this disclosure will be thorough and complete, and will fully convey the scope of the inventive concept to those skilled in the art. Like numbers refer to like elements throughout the description.

The present disclosure relates to a swing arm linkage, or swing arm assembly, for a mid-wheel drive wheelchair. The swing arm linkage has a first swing arm, or first pivot arm, a second swing arm, or second pivot arm, and a linkage member which connects the first swing arm with the second swing arm, thereby allowing force transfer between the second swing arm and the first swing arm. In particular, the linkage member is configured to transfer a pivot motion of the second swing arm to a pivot motion of the first swing arm.

Hereto, the first swing arm has a linkage member first mounting point and the second swing arm has a linkage member second mounting point. The linkage member is configured to be connected to the linkage member first mounting point. The linkage member is furthermore configured to be connected to the linkage member second mounting point. A first straight line being formed between the first swing arm pivot point and the linkage member first mounting point, and a second straight line being formed between the second swing arm pivot point and the linkage member second mounting point. As mentioned earlier, these straight lines are imaginary lines merely introduced for the definition of certain angles. The linkage member first mounting point and the linkage member second mounting point are so arranged relative to each other that the sum of an angle α between the linkage axis and a line perpendicular to the first straight line and extending from the linkage member first mounting point and an angle β between the linkage axis and a line perpendicular to the second straight line and extending from the linkage member second mounting point is constant or increasing with increasing ditch angle. The sum of the angles α and β is in particular constant or increases as the ditch angle increases from 0 degrees to angles in the order of tens of degrees.

The linkage member has an elongated shape and extends between the linkage member first mounting point and the linkage member second mounting point. The linkage member may comprise at least one rigid member or may comprise at least one resilient member or may comprise a combination of both rigid and resilient members. Using resilient members alone or in combination with rigid members may contribute to an increased ride comfort for the user. The length of the linkage member is dependent on the placement of the first and second mounting points.

Examples of a swing arm linkage will now be described with reference to FIGS. 1-6.

FIG. 1 depicts an example of a swing arm linkage 1 for a mid-wheel drive wheelchair. The swing arm linkage 1 comprises a first swing arm 3, a second swing arm 5 and a linkage member 7. According to the present example, the first swing arm 3 is a rear swing arm and the second swing arm 5 is a front swing arm, but it could alternatively be the other way around.

The first swing arm 3 has a first swing arm pivot point 3*a*. The first swing arm 3 is configured to be pivotally connected to a chassis 9 of a mid-wheel drive wheelchair, at the first swing arm pivot point 3*a*, which thus forms a pivot axis of the first swing arm 3.

The first swing arm 3 has a linkage member first mounting point 3*b* to which the linkage member 7 is configured to be connected. The first swing arm 3 has a portion 3*c* extending from the first swing arm pivot point 3*a*, configured to cause pivoting of the first swing arm 3 about the first swing arm pivot point 3*a*. The linkage member first mounting point 3*b* is provided on the portion 3*c* and the linkage member 7 is thus connected to this portion 3*c*.

The second swing arm 5 has a second swing arm pivot point 5*a*. The second swing arm 5 is configured to be pivotally connected to the chassis 9 at the second swing arm pivot point 5*a*, which thus forms a pivot axis of the second swing arm 5. The second swing arm 5 has a portion 5*c* extending from the second swing arm pivot point 5*a*. The linkage member second mounting point 5*b* is provided on the portion 5*c* and the linkage member 7 is thus connected to this portion sc.

The first swing arm 3 and the second swing arm 5 may furthermore have a respective caster wheel assembly 3*d*, 5*d*. Hereto, the first swing arm 3 may include a first caster wheel assembly 3*d* and the second swing arm 5 may include a second caster wheel assembly 5*d*.

To facilitate the understanding of where the swing arm linkage 1 is located on the chassis 9, relative to a drive wheel, a drive wheel hub 11 is also shown, to which a drive wheel is configured to be mounted. The drive wheel hub 11 is arranged between the rear caster wheel assembly 3*d* and the front caster wheel assembly 5*d*.

Figure 2:
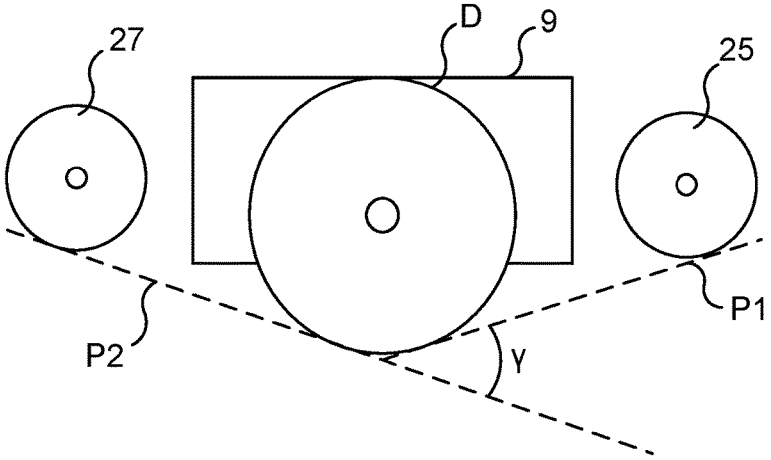
FIG. 2 schematically illustrates the definition of the ditch angle.

FIG. 2 shows a definition of the ditch angle γ. The ditch angle γ is the acute angle between the two planes P1 and P2 of which the first plane P1 is tangent to both the second caster wheel 25 contact point to the ground and a ground contact point of the drive wheel D, and the second plane P2 is tangent to the first caster wheel 27 ground contact point and a drive wheel D ground contact point.

Figure 3:
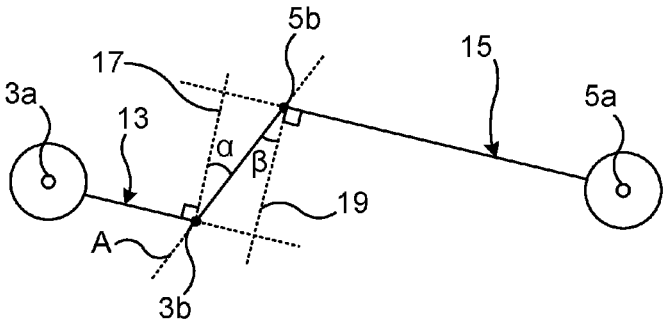
FIG. 3 shows one aspect of the geometry of the swing arm linkage in FIG. 1, illustrating angles α and β.

FIG. 3 shows a diagram of one aspect of the geometry of the swing arm linkage 1. Hereto, only the first swing arm pivot point 3*a*, the linkage member first mounting point 3*b*, the second swing arm pivot point 5*a* and the linkage member second mounting point 5*b*, and their relative location is shown. The linkage member 7 has an elongated shape and defines a linkage axis A, extending between the linkage member first mounting point 3*b* and the linkage member second mounting point 5*b*. A first straight line 13 extending between the first swing arm pivot point 3*a* and the linkage member first mounting point 3*b* has been drawn in FIG. 3. Moreover, a line 17 perpendicular to the first straight line 13 and extending from the linkage member first mounting point 3*b* is shown, extending in the same plane as the first straight line 13 and the linkage axis A. Similarly, a second straight line 15 extending between the second swing arm pivot point 5*a* and the linkage member second mounting point 5*b* has been drawn. Moreover, a line 19 perpendicular to the second straight line 15 and extending from the linkage member second mounting point 5*b* is shown, extending in the same plane as the second straight line 15, the first straight line 13 and the linkage axis A. The linkage member first mounting point 3*b* and the linkage member second mounting point 5*b* are so arranged relative to each other that the sum of the angle α between the linkage axis A and the line 17 perpendicular to the first straight line 13 and the angle β between the linkage axis A and the line 19 perpendicular to the second straight line 15 is constant or increasing with increasing ditch angle. According to one variation, the sum is less than 30 degrees at zero ditch angle.

The sum of the absolute values of angles α and β, alternatively expressed as the composite angle of α and β, may according to one variation be less than 25 degrees at zero ditch angle, for example less than 20 degrees, or less than 15 degrees or less than to degrees. According to one variation, the composite angle of α and β may be 0 degrees at zero ditch angle.

As can be seen in FIG. 3, the line 17 perpendicular to the first straight line 13 intersects an extension of the second straight line 15. Similarly, the line 19 perpendicular to the second straight line 15 intersects an extension of the first straight line 13. It is to be noted that the extensions of the imaginary lines 13 and 15 are also imaginary.

Figure 4:
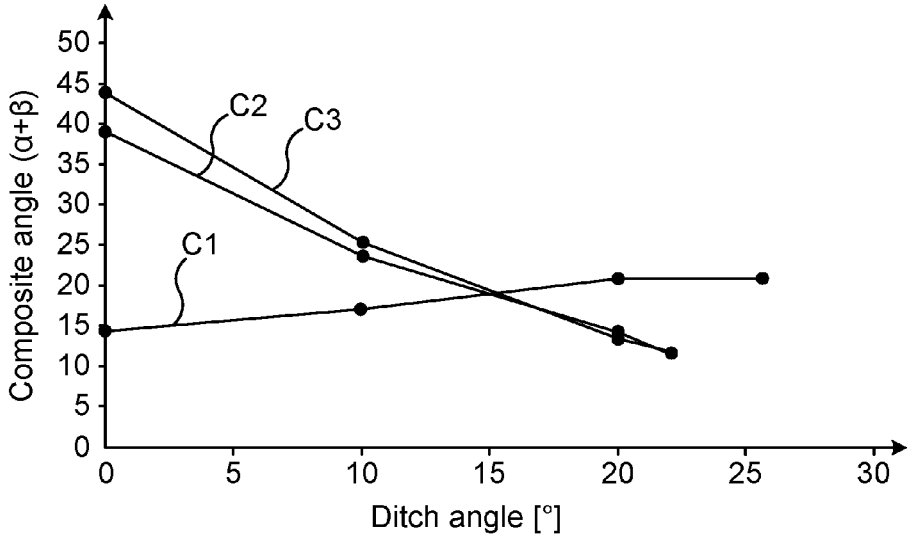
FIG. 4 is a graph that shows the composite angle (the sum of angles α and β) as a function of the ditch angle for a number of swing arm linkage designs.

FIG. 4 shows a plot of a number of tests performed by the inventors for mid-wheel drive wheelchairs having swing arm linkages with different geometries. One of the tests, described by curve C1, is an example of the swing arm linkage 1 disclosed herein, the others (curves C2 and C3) having the sum of angles α and β decreasing with increasing ditch angle and the sum has a value greater than 30 degrees at zero ditch angle. Here, the ditch angle is plotted for each of three cases until the drive wheels have lost traction with the underlying support.

As noted above, curve C1 describes the behaviour of a mid-wheel drive wheelchair having a swing arm linkage according to a variation of the swing arm linkage 1 where the sum of the angles α and β is less than 25 degrees for ditch angles up until the drive wheels lose traction with the underlying support. In the example, the composite angle of α and β is essentially 20 degrees at its maximum.

As can be seen in the plot, curves C2 and C3 which describe geometries having composite angles greater than 30 degrees in the specified range reduce their composite angle as the ditch angle increases, while for the example described by curve C1 the composite angle is slightly increased as the ditch angle is increased. It can furthermore be noted that the test where the composite angle is less than 25 for any ditch angle in the test range, i.e. curve C1, maintains traction with the underlying support for a greater ditch angle than the tests described by curves C2 and C3.

Figure 5:
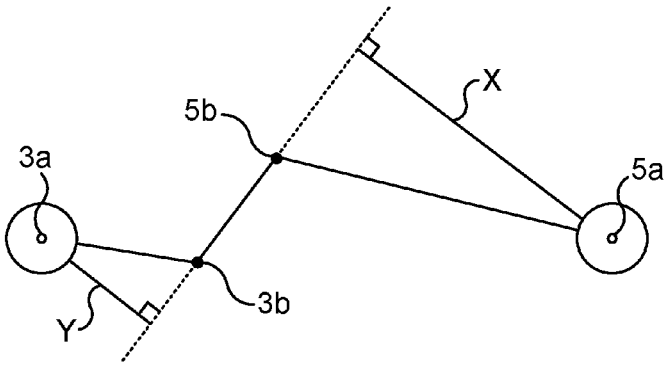
FIG. 5 shows another aspect of the geometry of the swing arm linkage in FIG. 1, illustrating leverage arms X and Y.

With reference to FIG. 5 another aspect of the geometry, according to one variation of the swing arm linkage 1, will now be described. According to the example shown in FIG. 5, a diagram of a geometry of one variation of the swing arm linkage 1 is shown, with the positions of the first swing arm pivot point 3*a*, the linkage member first mounting point 3*b*, the second swing arm pivot point 5*a* and the linkage member second mounting point 5*b* being depicted. The leverage arm X of the second swing arm 5 is also shown, as is the leverage arm Y of the first swing arm 3. According to one variation, the ratio between the leverage arm X of the second swing arm 5 and the leverage arm Y of the first swing arm 3 is constant with increasing ditch angle. According to a variation, the ratio is in the range between 2 and 3 for any ditch angle between 0 and 25 degrees. This ratio is preferably kept as constant as possible over the range of ditch angles, thereby ensuring that the force transfer for any given force will be the same or essentially the same for any ditch angle.

Figure 6:
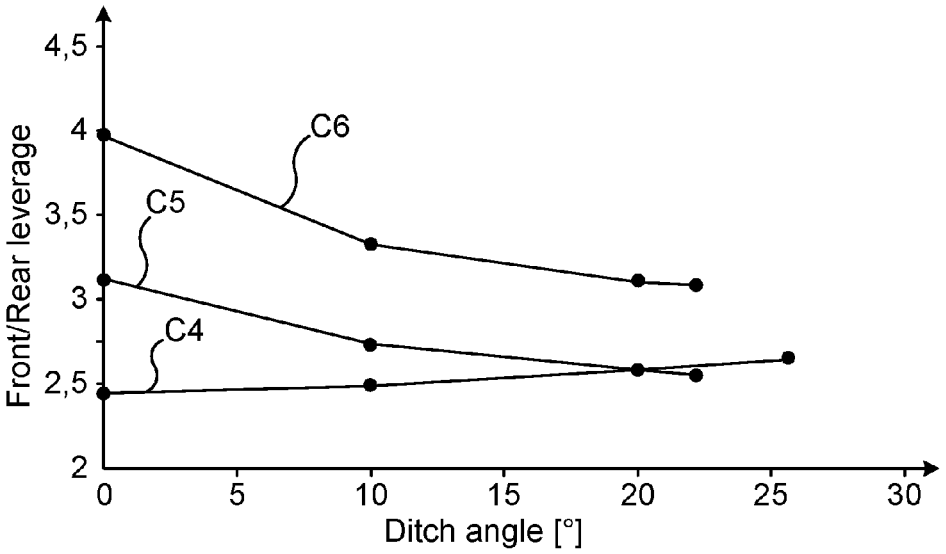
FIG. 6 is a graph that shows the front/rear leverage arm ratio as a function of the ditch angle for a number of swing arm linkage designs.

FIG. 6 shows a plot of a number of tests performed on mid-wheel drive wheelchairs having different geometries. Curve C4 shows an example of a geometry where the ratio between the leverage arm X of the second swing to arm 5 and the leverage arm Y of the first swing arm 3 is in the range between 2 and 3, for any ditch angle in the range 0 to 25 degrees. The geometry of the swing arm linkage described by curve C4 furthermore has the geometry previously described, with the composite angle being below 30 degrees for any ditch angle in the range 0 to 25 degrees. More specifically, the swing arm linkage used in the test shown in FIG. 5 described by curve C4 is the same swing arm linkage used in the test described by curve C1 in FIG. 4. It can again be observed that traction will be provided for greater ditch angles than for the other swing arm linkages used in the test.

Figure 7:
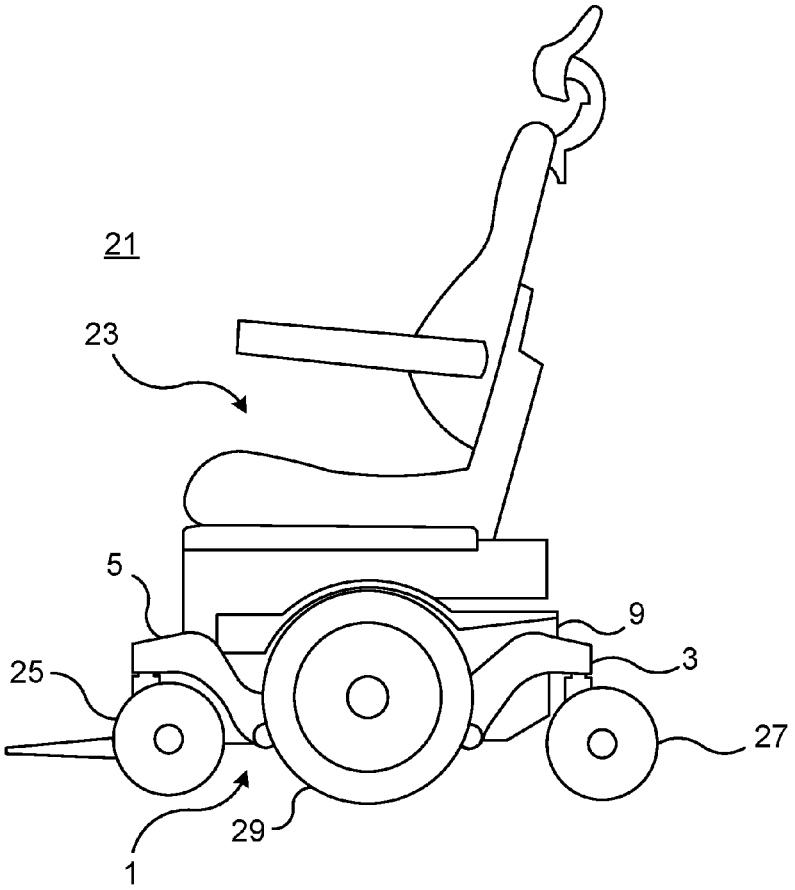
FIG. 7 schematically shows a side view of a mid-wheel drive wheelchair comprising the swing arm linkage in FIG. 1.

FIG. 7 shows an example of a mid-wheel drive wheelchair 21, i.e. a wheelchair that is powered by means of a drive wheel arranged between front caster wheels and rear caster wheels. Hereto, the mid-wheel drive wheelchair 21 has a seating system 23, a chassis 9, and a swing arm linkage 1 mounted to the chassis 9 and provided with a front caster wheel 25 and rear caster wheel 27.

The inventive concept has mainly been described above with reference to a few examples. However, as is readily appreciated by a person skilled in the art, other embodiments than the ones disclosed above are equally possible within the scope of the inventive concept, as defined by the appended claims.

The invention claimed is:

1. A swing arm linkage for a mid-wheel drive wheelchair comprising a first caster wheel, a second caster wheel and a drive wheel, comprising:

a first swing arm having a first swing arm pivot point and a linkage member first mounting point, a second swing arm having a second swing arm pivot point and a linkage member second mounting point, a linkage member configured to be connected to the linkage member first mounting point and to the linkage member second mounting point, to enable force transfer between the second swing arm and the first swing arm, wherein the linkage member has an elongated shape defining a linkage axis extending between the linkage member first mounting point and the linkage member second mounting point, a first straight line being formed between the first swing arm pivot point and the linkage member first mounting point, and a second straight line being formed between the second swing arm pivot point and the linkage member second mounting point, wherein the linkage member first mounting point and the linkage member second mounting point are so arranged relative to each other that the sum of an angle α between the linkage axis and a line perpendicular to the first straight line and extending from the linkage member first mounting point and an angle β between the linkage axis and a line perpendicular to the second straight line and extending from the linkage member second mounting point is constant or increasing with increasing ditch angle, the ditch angle being the acute angle between two planes of which a first plane is tangent to both a second caster wheel contact point to ground and a ground contact point of a drive wheel, and a second plane is tangent to a first caster wheel ground contact point and a drive wheel ground contact point.

2. The swing arm linkage of claim 1, wherein the sum of the angles α and β is less than 30 degrees at a ditch angle of 0 degrees.

3. The swing arm linkage of claim 1, wherein the sum of the angles α and β is less than 25 degrees at a ditch angle of 0 degrees.

4. The swing arm linkage of claim 1, wherein the sum of the angles α and β is less than 20 degrees at a ditch angle of 0 degrees.

5. The swing arm linkage of claim 1, wherein the sum of the angles α and β is less than 10 degrees at a ditch angle of 0 degrees.

6. The swing arm linkage of claim 1, wherein the ratio between the leverage arm of the second swing arm and the leverage arm of the first swing arm is constant with increasing ditch angle.

7. The swing arm linkage of claim 1, wherein the ratio between the leverage arm of the second swing arm and the leverage arm of the first swing arm is between 2 and 3 for any ditch angle between 0 and 25 degrees.

8. The swing arm linkage of claim 1, wherein the first swing arm is a rear swing arm and the second swing arm is a front swing arm.

9. The swing arm linkage of claim 1, wherein the line perpendicular to the first straight line intersects an extension of the second straight line, and the line perpendicular to the second straight line intersects an extension of the first straight line.

10. A mid-wheel drive wheelchair comprising the swing arm linkage of claim 1.

11. The mid-wheel drive wheelchair of claim 10, comprising a chassis, wherein the first swing arm is pivotally connected to the chassis via the first swing arm pivot point and the second swing arm is pivotally connected to the chassis via the second swing arm pivot point.

* * * * *